US005211321A

United States Patent [19]

Rodriguez

[11] Patent Number: 5,211,321

[45] Date of Patent: May 18, 1993

[54] BATTERY AND EQUIPMENT VEST

[76] Inventor: Norton Rodriguez, 1721 SW. 73 Court Rd., Miami, Fla. 33155

[21] Appl. No.: 797,378

[22] Filed: Nov. 25, 1991

[51] Int. Cl.[5] ..... A45F 3/04

[52] U.S. Cl. ..... 224/215; 224/902; 224/209; 224/224; 224/227; 2/94

[58] Field of Search ..... 224/215, 209, 224, 227, 224/228, 902, 901; 2/94, 102

[56] References Cited

U.S. PATENT DOCUMENTS

| | | | |
|---|---|---|---|
| 1,290,827 | 1/1919 | Yergason | 224/215 X |
| 3,105,241 | 10/1963 | Allen | 2/94 |
| 3,258,182 | 6/1966 | McDonald | 224/215 X |
| 3,919,615 | 11/1975 | Niecke | 224/226 X |
| 4,106,121 | 8/1978 | Belson | 2/94 X |
| 4,108,341 | 8/1978 | Pettinger | 224/224 |
| 4,369,526 | 1/1983 | Clutts | 2/102 X |
| 4,601,067 | 7/1986 | Buonassissi | 2/94 X |
| 4,669,127 | 6/1987 | Swanson | 2/94 X |
| 5,024,360 | 6/1991 | Rodriguez | 224/215 |

FOREIGN PATENT DOCUMENTS

| | | | |
|---|---|---|---|
| 125992 | 7/1949 | Sweden | 224/214 |

*Primary Examiner*—Allan N. Shoap
*Assistant Examiner*—Paul Schwarz
*Attorney, Agent, or Firm*—Malloy, Downey & Malloy

[57] ABSTRACT

A battery and equipment vest, to be rechargeably used to provide power to video, recording, and like equipment. The battery and equipment vest which also provides numerous storage pockets, may utilize a battery belt or integrally disposed batteries and recharging equipment to provide a mobile, conveniently disposed power source, which may be recharged without removal from the vest. In order to insure a comfortable fit for multiple users, the battery and equipment vest has adjustable shoulder straps and an adjustable waist design which is structured and disposed to orderly maintain electrical interconnection between front portions and rear portions of the vest when worn by any size user. Additionally, fastener hooks and accessory rings are employed for attaching a wide variety of peripheral equipment, supplies, tools, and extra batteries.

27 Claims, 4 Drawing Sheets 156
152
41
40
31
30
32
42
43
10
37
20
157
50
170
51
52
158
55
22
172
55
24
155
100
160
162
70
48
160
160
71

10
152
156
42
56
43
56
40
41
20
32
31
157
69
68
170
66
60
172
25
22
35
30
100
160
48
160
160

10
41
40
56
31
50
55
24
30
20
100
160
160
48
160
35

59
59
58

BATTERY AND EQUIPMENT VEST

BACKGROUND OF THE INVENTION

1. Field of the Invention

This invention relates to a vest-like article of clothing structured to carry items on a person's upper body. More particularly, it relates to a vest-like article of clothing structured to carry items such as photographic equipment and batteries in such a manner that the batteries can transmit electrical current from within the vest to equipment being used such as a camera, and in such a manner that the batteries can be charged or recharged while in the vest when the vest is not in use. Additionally, the vest-like article of clothing has specific structural features which enable the vest to be used by persons of all sizes, while maintaining electrical interconnection.

2. Description of Related Art

Activities such as professional photography require individuals to carry and to use efficiently a large assortment of equipment and supplies. Included are cameras, portable batteries, portable lights, videotape, film, recording tools, writing instruments, documents and individual identification. Currently, such articles are carried in various bags, pockets, cartons and cases. As a result of relatively unorganized carriage of this equipment and supplies, their use by professional or amateur photographers, artists or others, consumes excessive time and mental energy. Additionally, recharging of the batteries and care of equipment when not in use also consumes a large portion of time that could be decreased with an effective tool for handling and using such items. That is the nature and purpose of this invention. It is a tool, in the form of an apparel articles, that is worn in electrical-supply and tool placement working relation with photographic equipment or other types of equipment, and may also be utilized to recharge electrical energy conveniently and efficiently when not in use. Furthermore, the present invention is particularly structured to fit all sizes of individuals by an adjusting waist structure. Usually, vest or like articles must be particularly sized for an individual user, especially if there are any internal interconnected parts, but applicant's invention enables ordered and continued interconnection of internal features despite the adjusted size, thereby enabling multiple users to wear the same vest.

Prior art is demonstrated in the following U.S. patents. U.S. Pat. No. 4,108,341 discloses a carrying belt for objects comprising several compartments on a protective cover of synthetic plastic material supported by a belt of synthetic plastic material having a buckle and closure tongue. U.S. Pat. No. 4,106,121 discloses a tactical load-bearing vest designed to carry supplies necessary for combatants in certain military operation or the like.

An infiltrator vest is shown in U.S. Pat. No. 3,529,307. It is designed to carry equipment necessary for survival in combat conditions. Similarly, a pack carrier is disclosed in U.S. Pat. No. 3,114,486. This load-carrying device is in the form of a corset-like harness or frame assembly which places the stress of a load generally in the area of the hips of an individual.

A utility vest is shown in U.S. Pat. No. 4,369,526. This vest type of structure is designed with pouches of various shapes and sizes to hold various occupational tools and is not related to the maintenance, supply or carrying of a portable electrical current or power source.

A pack vest is shown in U.S. Pat. No. 4,669,127. It is structured to define a utility garment for load portage in the shape of a vest containing load-carrying compartments on the back and front flaps of the vest.

A vest-like structure for a photographer is shown in U.S. Pat. No. 4,241,459. This vest structure includes a plurality of pockets for carrying various types of photographic equipment or the like.

Additionally, U.S. Pat. No. 4,024,360 granted to the applicant on Jun. 18, 1991, discloses a vest or like article of clothing for carrying rechargeable batteries, which has a plurality of interconnected pouches for holding batteries, and a belt-like fastening means passing therethrough which functions to tighten and loosen the vest around the user. This vest, however, does not includes the great degree of waist adjustability provided by the applicant's new invention, and does not contain the quantity of pockets and internal compartments which facilitate ordered interconnection of all parts of the vest despite the size of the user. Further, the vest of the present invention may be utilized and fastened to the user's upper body in a secure, stabilized position without the need of an extended belt about the waist portion.

While all of the above prior art devices in the referenced patents are assumed to be operable for their intended function, none discloses an article of clothing of vest-type structure specifically designed to carry rechargeable batteries in a manner that electrical current is supplied from them for powering equipment when in use and supplied to them for recharging when not in use. Additionally, none provide for carriage of batteries and such items as photographic equipment in ways that can be used efficiently with minimal stress on the lower back of a wearer's body, and that may be adjustably fitted for multiple users while still remaining functionally interconnected.

SUMMARY OF THE INVENTION

An apparel article comprising a vest-type article for carrying electrical conduction means such as a battery, a battery charger and plugs, and carrying related equipment, tools and supplies. A charger is carried optionally in the vest or an outside charger unit can be employed and the batteries can be used or charged without removal from the vest. The battery and equipment vest is adjustable with shoulder straps and waist straps to fit all sizes of users, while maintaining ordered interconnection. Fastener hooks and accessory rings are employed for attaching a wide variety of peripheral equipment, supplies, tools and extra batteries. Electrical interconnectors connect the batteries for use in series, parallel or singly. Separate embodiments of the invention provide for attaching a plurality of batteries with an attachable belt, in battery containers positioned on the vest, or integrally constructed as part of the vest.

BRIEF DESCRIPTION OF THE DRAWINGS

For a fuller understanding of the nature of the present invention, reference should be had to the following detailed description taken in connection with the accompanying drawings, in which.

Like reference numerals refer to like parts throughout the several views of the drawings.

DESCRIPTION OF THE PREFERRED EMBODIMENT

Figure 1:
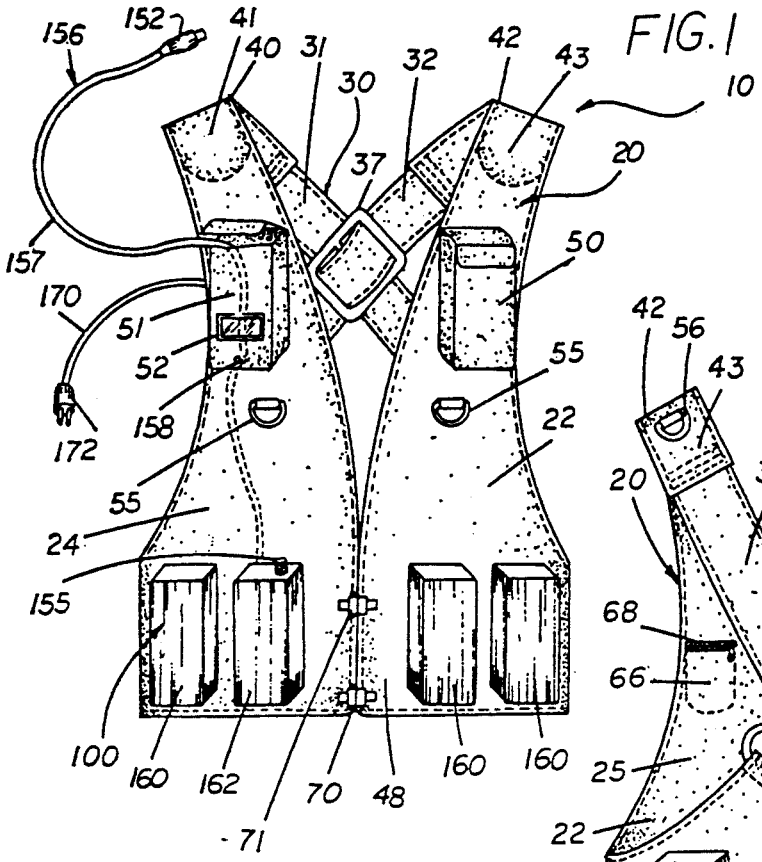
FIG. 1 is a front view of a battery and equipment vest.
Figure 2:
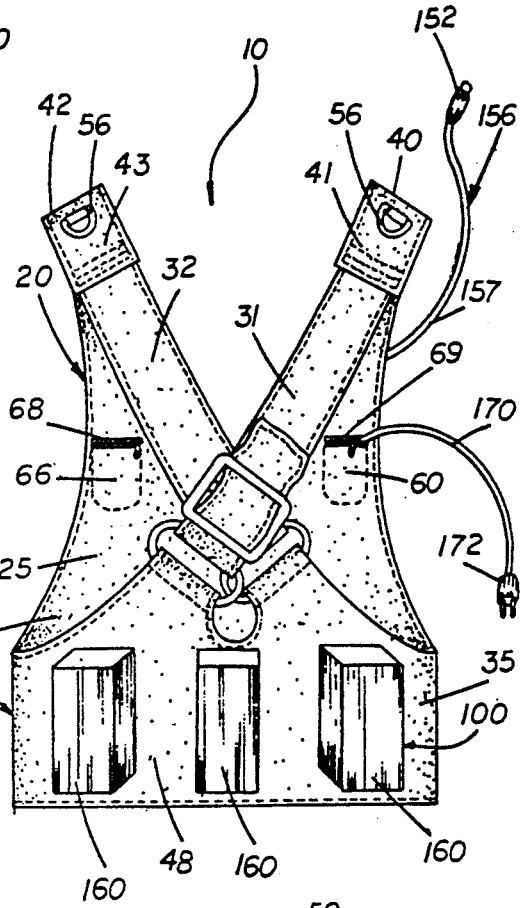
FIG. 2 is a rear view of the battery and equipment vest.
Figure 3:
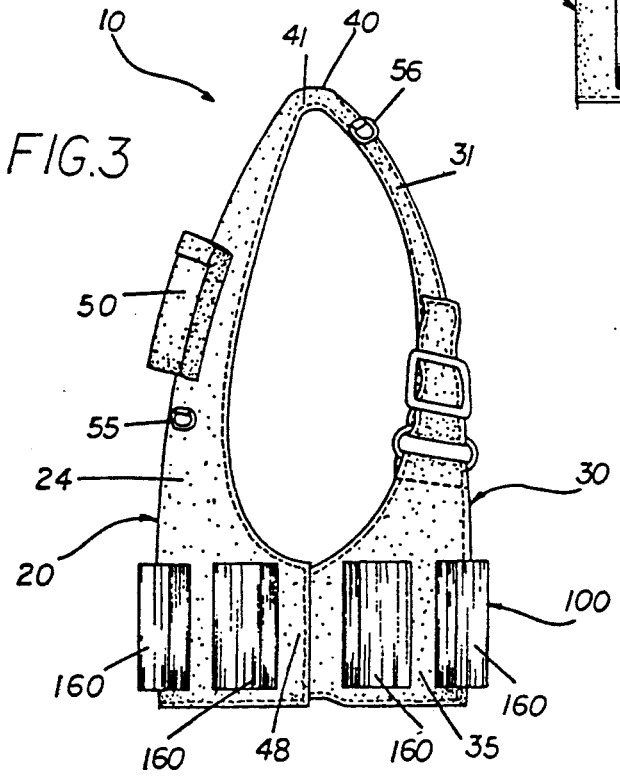
FIG. 3 is a left side view of the battery and equipment vest.
Figure 4:
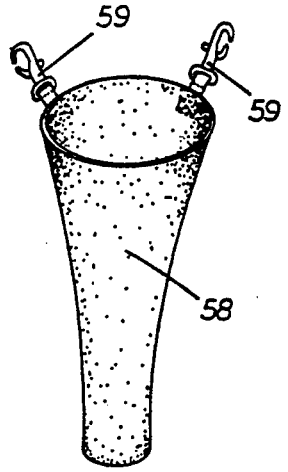
FIG. 4 is a perspective view of an optional backpack.

Shown throughout FIGS. 1-10 are two preferred embodiments of a battery and equipment vest generally indicated as 10.

Detailed in FIGS. 1, 2, 3, and 5 is a first embodiment of the battery and equipment vest 10. The battery and equipment vest 10 includes a front portion generally indicated as 20 and a rear portion generally indicated as 30. The front portion 20 is divided into a left chest panel 22 and a right chest panel 24 which are connected at a left shoulder 42 and a right shoulder 40, respectively, to a pair of adjustable straps 31 and 32 of the rear portion 30. The shoulders 40 and 42 each include padding 41 and 43 in order to provide a more comfortable fit when carrying heavy equipment in the vest, as well as to provide a more comfortable place to position a video camera or like heavy object that must be carried on the shoulder. The strap 31 and 32 which overlap, are connected to a lower back panel 35, and may be held in a non-sliding crisscross orientation by an optional cross holder 37. Disposed on an upper portion of the left chest panel 22 and right chest panel 24, are a pair of outer chest pockets 50 and 51 which are designed to hold tapes, cords, and other necessary equipment. Additionally, an ID compartment 52 may be included on one of the outer chest pockets 50 and 51. Connecting the left chest panel 22 and the right chest panel 24 is a front fastener 70 and an optional secondary fastener 71 which function to maintain the front portion 20 secured around the user. Additionally, front rings 55 and rear rings 56 are positioned on the front portion 20 and the rear portion 30, respectively, so as to provide a facilitated means of clipping and hooking necessary items, such as a backpack 58 with clip on means 59 shown in FIG. 4. Additionally, the back D-rings 56 are also used for hanging the vest when not in use.

Figure 5:
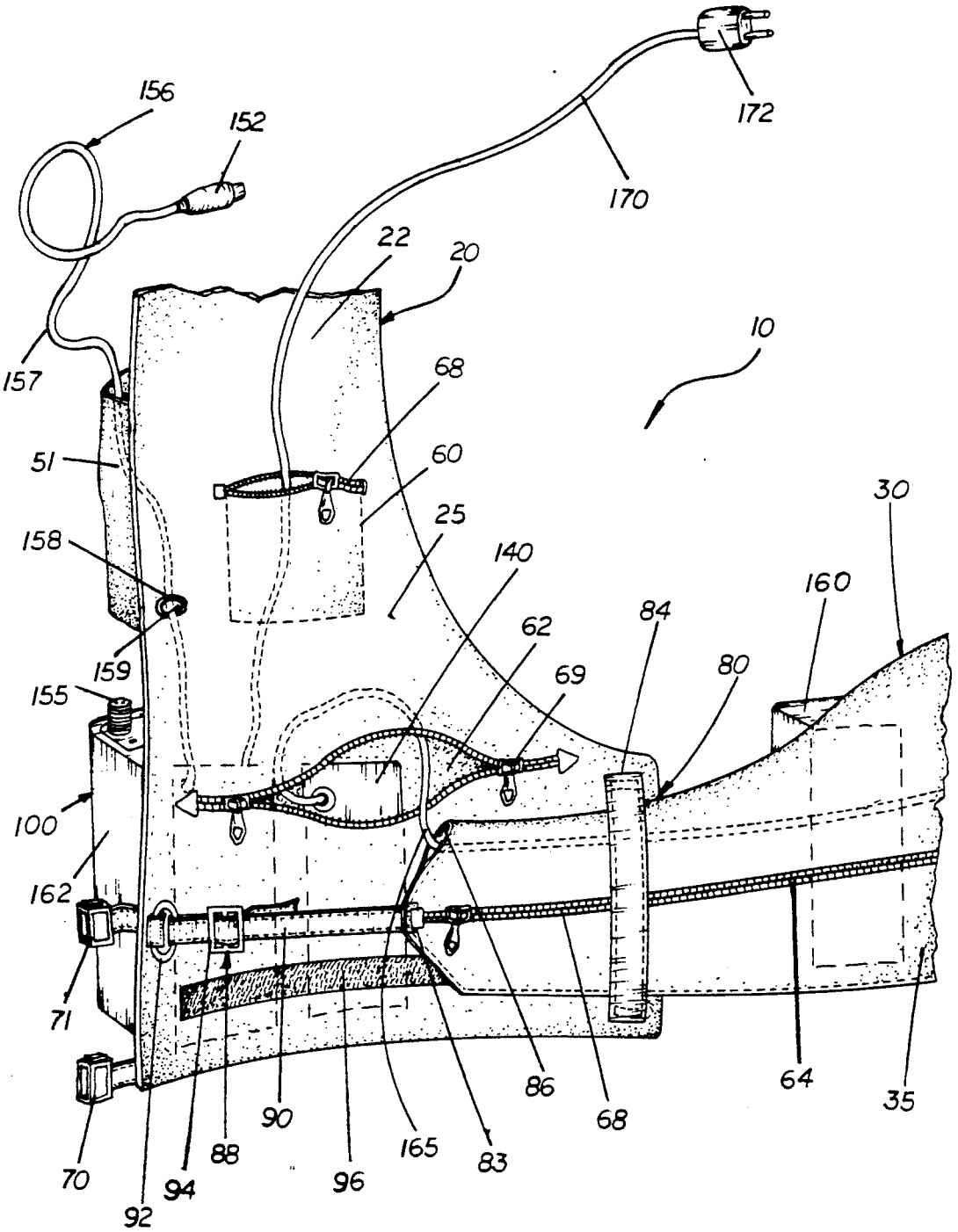
FIG. 5 is a detailed view of the waist adjusting means and interior of a battery and equipment vest.

Turning to FIG. 5, waist adjustment means 80 have been included to connect the opposite distal ends of the lower back panel 35 with the left chest panel 22 and the right chest panel 24. The waist adjustment means 80 include a pair of tongue-like flaps 81 extending from opposite distal ends of the lower back panel 35. The tongue-like flaps 81 are structured to be fitted through a pair of strap-like loops 84 which are attached to the interior surface 25 of the left chest panel 22 and the right chest panel 24. Attached to the distal end 83 of the tongue-like flaps 81 are adjustable fastening means 88 which include a belt 90 which may be passed through a loop 92 attached to the left chest panel 22 and right chest panel 24, and further passed through a buckle 94 in order to maintain secure tight positioning. Additionally, hook and loop fasteners 96 have been correspondingly positioned on the tongue-like flaps 81 and the interior surface 25 of the left chest panel 22 and right chest panel 24 so as to further maintain a secure fastened orientation about a user. Disposed at various positions inside the battery and equipment vest 10 are a plurality of interior compartments 60, 62, 64, and 66, which have either single zippered openings 68 or double zippered openings 69 to facilitate access and secure items within them.

Disposed along an exterior waist area of the battery and equipment vest 10 are the electrical conduction means 100. In the first embodiment, the electrical conduction means 100 are integrally attached as part of the battery and equipment vest 10 through a plurality of battery compartments 160 which extend around the exterior waist area 48. Located within the battery compartments 160 are batteries and/or charger 140. These batteries and charger 140 are interconnected by an adjustable interconnecting conductor 165. The adjustable interconnection conductor 165 which extends internally through the lower back panel 35 and the tongue-like flaps 81 extends from an aperture 86 at the distal end 83 of the tongue-like flaps 81. The adjustable interconnection conductor 165 extends from the aperture 86 and into a double zipped 69 interior pocket 62 wherein it connects with a battery 140 and wherein extra unused length of the adjustable interconnecting conductor 165 may be stored when the battery and equipment vest is adjusted to a smaller waist. The interior compartments 62 and 64 function as interior accesses to the battery compartment 160. Protruding from a battery charger 162 or other battery compartments 160 is one or more DC output connectors 155 whereon equipment power cables may be attached. Additionally, an optional secondary DC output 156 may be included, extending internally from a battery 140 passing through an opening 159 into an outer chest pocket 51. The secondary DC power output 156 is comprised primarily of a power cable 157 and a power plug for a camera or like equipment 152, all or part of which may be stored within the outer chest pocket 51 when not in use. Surrounding the opening 159 is a grommet 158 which functions to assure that the secondary DC power output 156 may not slide completely into or out of the interior of the battery and equipment vest 10, but may be orderly stored and easily used. Also extending internally from a battery charger 140 is an AC cord 170 having a plug 172 at its distal end which is capable of being plugged into a wall outlet. The AC cord 170 extends from an interior compartment 60 wherein the AC cord 170 and plug 172 may be stored when not being used to charge the electrical conduction means 100. Accordingly, the battery and equipment vest 10 may be charged without the need to remove the individual battery and/or chargers 140.

Figure 6:
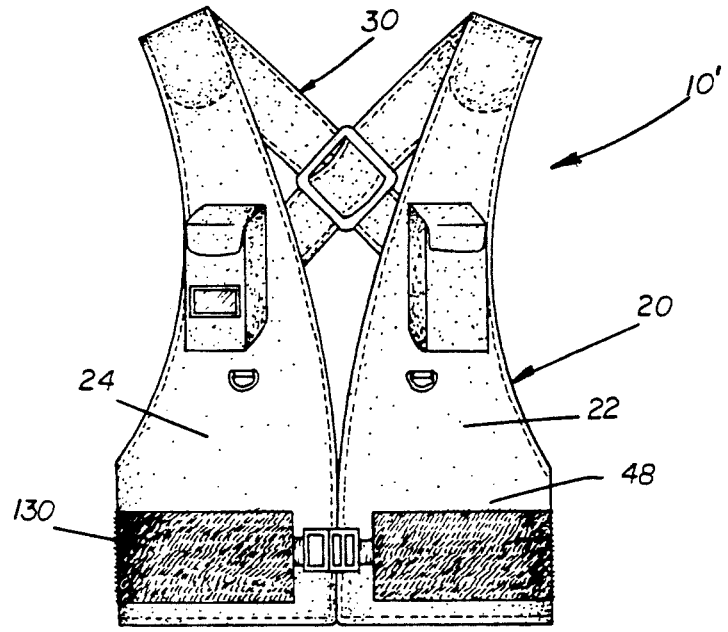
FIG. 6 is a front view of an alternate embodiment of a battery and equipment vest.
Figure 7:
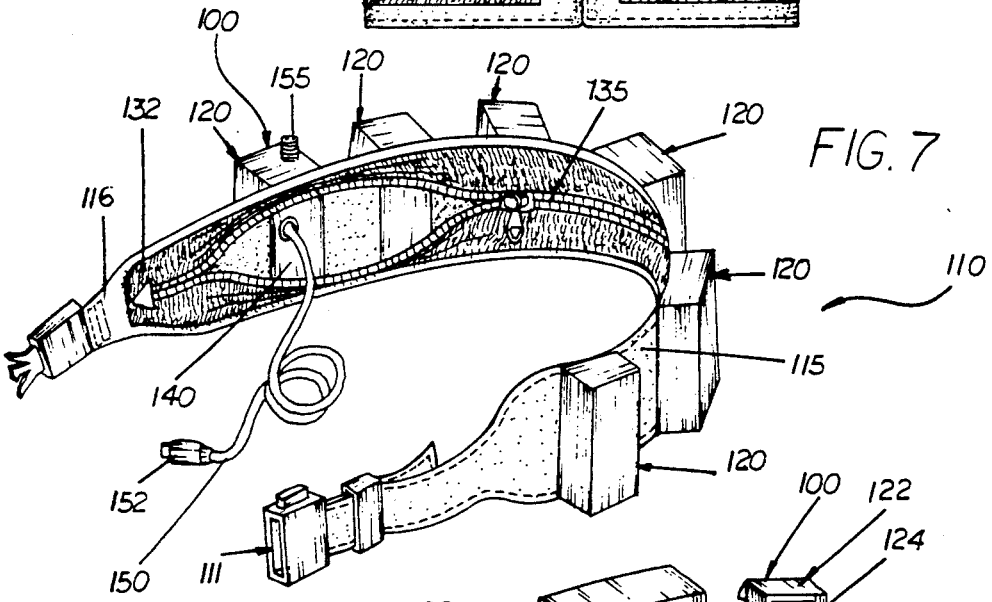
FIG. 7 is a perspective of a battery belt to be used in conjunction with the embodiment of FIG. 6.
Figure 8:
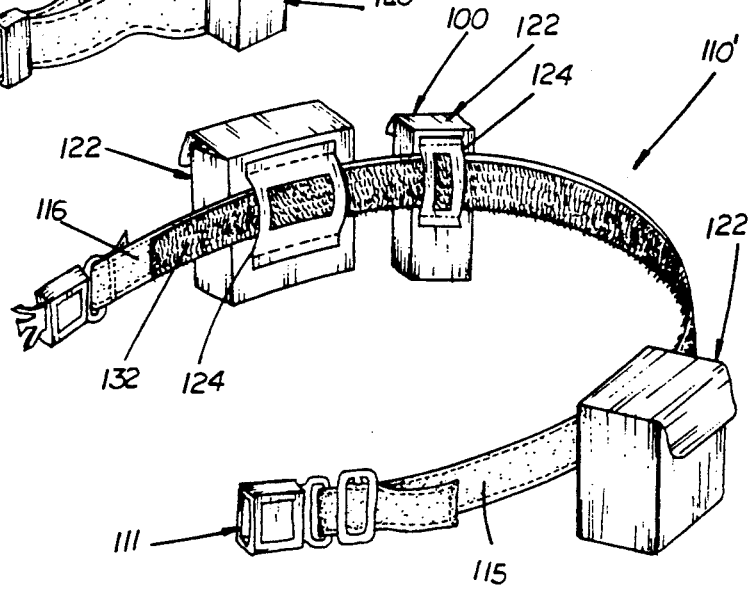
FIG. 8 is an alternate embodiment of a battery belt to be used in conjunction with the embodiment of FIG. 6.

FIG. 6 is a second embodiment of the battery and equipment vest 10, which includes hook and loop fastening means 130 disposed about the exterior waist area 48. The equipment vest 10' is specifically designed to facilitate attachment of various designs of battery belts 110, 110', and 110" to exterior waist area 48 thereof. Shown in FIGS. 7 and 8 are specially structured battery belts 110 that have hook and loop fastening means 132 integrally attached to their interior surface 116. Shown in FIG. 7, is a battery belt 110 wherein the battery pouches 120 are integrally attached to the exterior surface 115 of the battery belt 110. Additionally, disposed along the interior surface 116 is a zippered opening 135 which provides access to batteries or chargers 140 and provides an optional means from which a DC power cable 150 may be extended. The belt 110' shown in FIG. 8 is of the type wherein pouches 122 for carrying film, photographic and video equipment are removably attached by flaps 124, thereby allowing a variation of the number and orientation of the pouches 122.

Figure 9:
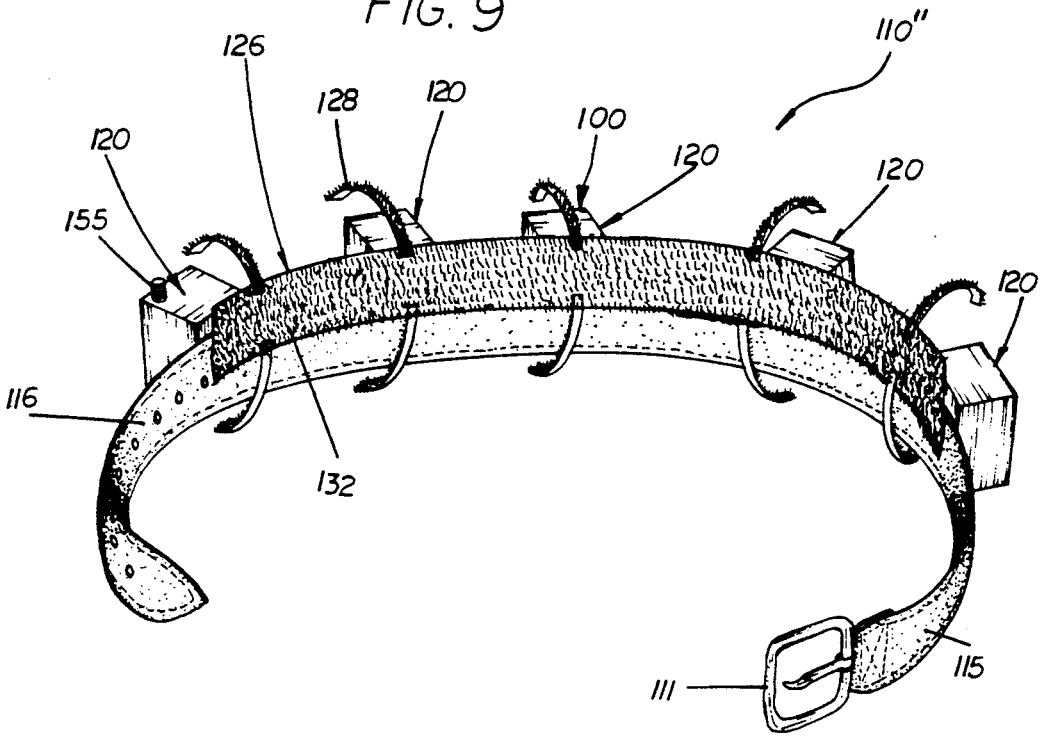
FIG. 9 is an exploded view of a standard battery belt adapted to be used in conjunction with the embodiment of Figure 6.

Turning to FIG. 9, a standard battery belt 110" may be easily adapted for use with the battery and equipment vest 10 by utilizing an attachment adapter 126. The adapter 126 may be positioned along the interior surface 116 of the battery belt 110" and fastened to the battery belt 110" by attachment straps 128. Accordingly, the exposed surface of the adapter 126 which contains hook and loop fasteners 132 may be securely engaged about the exterior waist area 48 of the battery and equipment vest 10'.

Figure 10:
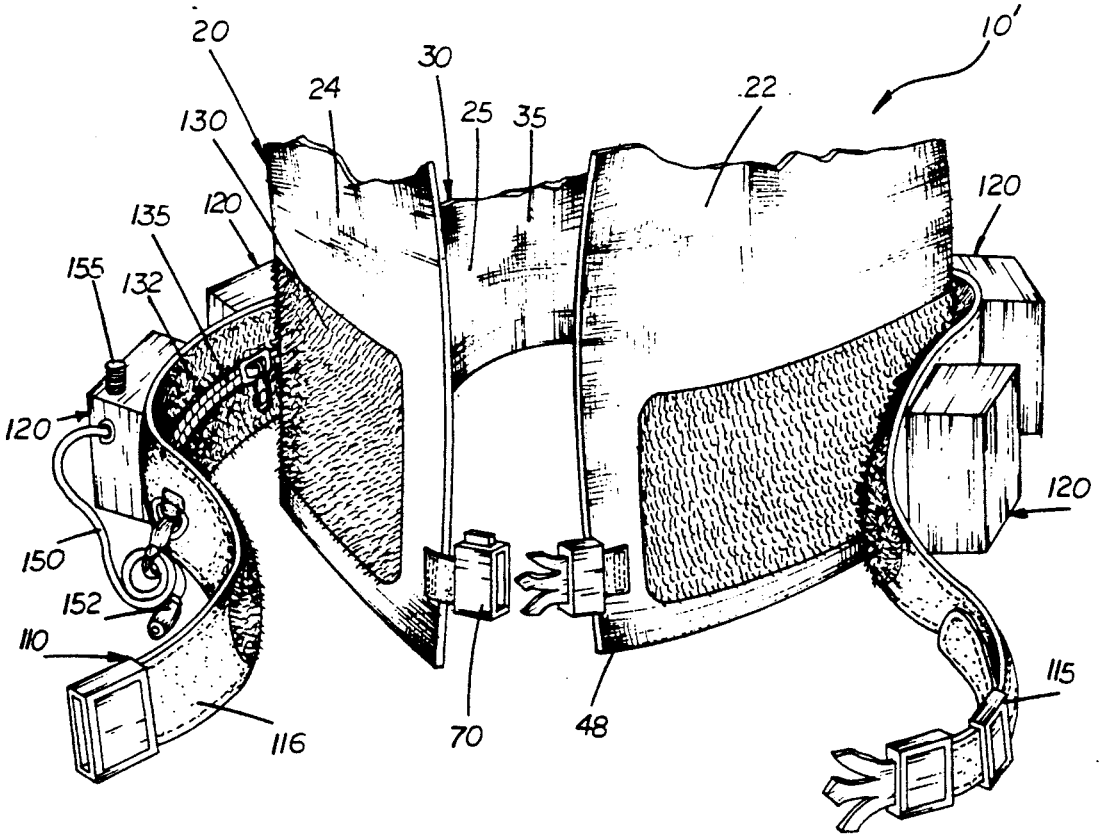
FIG. 10 is an exploded view illustrating attachment of the battery belt of FIG. 7 to the battery and equipment vest of FIG. 6.

As shown in FIG. 10, the battery belt 110 is attached to the battery and equipment vest 10' by means of the hook and loop fasteners 130 and 132. Additionally, closure means 111 on the battery belt 110 are utilized to further secure the battery belt 110 as well as to keep the front portion 20 of the battery and equipment vest 10 closed about a user.

It should be noted that the battery and equipment vest can also be made in various sizes, small, medium, large, and extra-large if desired.

Now that the invention has been described,

What is claimed is:

1. A battery and equipment vest comprising:

a vest-type article, said vest-type article including a front portion and a rear portion, said front portion and said rear portion integrally interconnected at a left shoulder and a right shoulder, said front portion including a left chest panel and a right chest panel extending beneath said left shoulder and said right shoulder, respectively, said front portion further including a front fastener for fastening a bottom portion of said left chest panel with a bottom portion of said right chest panel, said rear portion including a pair of adjustable straps extending from said left shoulder and said right shoulder in overlapping, crisscross relation with one another, said pair of adjustable straps being connected at lower distal ends thereof to a lower back panel, said lower back panel, said right chest panel, and said left chest panel including electrical conduction means for supplying electricity to peripheral equipment, said right chest panel and said left chest panel being adjustably attached to opposite distal ends of said lower back panel by waist adjustment means, said waist adjustment means including a pair of tongue-like flaps extending from, and integrally formed with, said opposite distal ends of said lower back panel, said tongue-like flaps having means for interconnecting said electrical conduction means in a hidden way between said front portion of said rear portion, said waist adjustment means further including a pair of strap-like loops positioned along an inside surface of said left chest panel and said right chest panel, such that each of said pair of tongue-like flaps may be adaptively received therethrough, and said waist adjustment means also including adjustable fastening means for fastening the waist adjustment means attached to a distal end of each of said pair of tongue-like flaps and to said inside surface of said left chest panel and said right chest panel.

2. A battery and equipment vest as recited in claim 1 wherein said front portion includes at least one outer chest pocket on an exterior upper portion thereof, which is structured and disposed to hold tapes, cables, and other necessary articles.

3. A battery and equipment vest as recited in claim 2 wherein said left shoulder and said right shoulder include padding therein.

4. A battery and equipment vest as recited in claim 3 wherein said front portion and said rear portion include a plurality of rings thereon, such that articles may be hooked or clipped thereto, or looped therethrough.

5. A battery and equipment vest as recited in claim 4 wherein said back portion includes a cross holder to hold said pair of adjustable straps in a fixed, overlapping, crisscross orientation.

6. A battery and equipment vest as recited in claim 5 wherein said front portion and said rear portion include a plurality of interior compartments accessible from inside surfaces thereof.

7. A battery and equipment vest as recited in claim 6 wherein each of said plurality of interior compartments have a zipper on an access opening to facilitate securement thereof.

8. A battery and equipment vest as recited in claim 6 wherein each of said plurality of interior compartments include a hook and loop fastener on an access opening to facilitate securement thereof.

9. A battery and equipment vest as recited in claim 6 wherein said adjustable fastening means includes a belt which passes through a loop on said inside surface of said left chest panel and said right chest panel, and is passed through a buckle positioned thereon.

10. A battery and equipment vest as recited in claim 9 wherein said waist adjustment means includes a hook and loop fastener disposed along said interior surface of said left chest panel and said right chest panel, and a corresponding surface of each of said tongue-like flaps, such that said front portion and said rear portion are securely and non-slidably interconnected.

11. A battery and equipment vest as recited in claim 10 wherein said electrical conduction means includes a battery belt having a plurality of pouches with batteries therein electrically interconnected and positioned along an exterior surface of said battery belt.

12. A battery and equipment vest as recited in claim 11 wherein an interior surface of said battery belt and an exterior waist area of said front portion and said rear portion have a hook and loop fastener correspondingly attached thereto.

13. A battery and equipment vest as recited in claim 12 wherein said pouches are removably attached to said battery belt.

14. A battery and equipment vest as recited in claim 12 wherein said pouches are integrally attached to said battery belt.

15. A battery and equipment vest as recited in claim 12 wherein said hook and loop fasteners are attached to said exterior waist area of said front portion and said rear portion, and to a belt liner which may be removably attached to said battery belt.

16. A battery and equipment vest as recited in claim 12 wherein said battery belt includes closure means for securing the belt attached to a distal end thereof.

17. A battery and equipment vest as recited in claim 14 wherein said interior surface of said battery belt includes a zippered openinq through which said pouches may be accessed, and a DC power cable may extend.

18. A battery and equipment vest as recited in claim 10 wherein said electrical conduction means includes a plurality of battery compartments having batteries therein, which are attached and electrically interconnected by said means for interconnecting along said exterior waist area of said front portion and said rear portion.

19. A battery and equipment vest as recited in claim 18 wherein said plurality of interior compartments provide access to said battery compartments on said front portion and said rear portion.

20. A battery and equipment vest as recited in claim 19 wherein said battery compartments on said front portion and said rear portion are electrically connected by said means for interconnecting, said means for interconnecting comprising an adjustable interconnecting electrical conductor which passes from an aperture on said distal end of each of said tongue-like flaps and into one of said interior compartments on a corresponding chest panel on said front portion wherein an excess of said interconnecting electrical conductor may be stored.

21. A battery and equipment vest as recited in claim 20 wherein said interior compartments further include a pair of upper compartments structured and disposed to receive small articles therein.

22. A battery and equipment vest as recited in claim 21 wherein said electrical conduction means includes an AC cord passing through one of said upper compartments which is internally connected to one of said batteries, has a plug on a distal end thereof for connecting said AC cord to a wall outlet or like power source for charging the batteries, and may be stored within said upper compartment when not in use.

23. A battery and equipment vest as recited in claim 22 wherein said electrical conduction means includes at least one DC power output connector protruding from one of said battery compartments.

24. A battery and equipment vest as recited in claim 23 wherein said electrical conduction means includes a secondary DC power output which is comprised of a substantially long power cable which passes through one of said outer chest pockets and has one distal end connected internally to one of said batteries, and a power plug at an opposite distal end thereof for attachment to camera equipment for supplying power thereto, said power cable being stored within said outer chest pocket when not in use.

25. A battery and equipment vest as recited in claim 24 wherein said outer chest pocket having said power cable passing therethrough includes a small grommet surrounding said power cable and attached at an opening through which said power cable enters said outer chest pocket, such that said power cable may be secured in place and not slide completely into or out of said front portion.

26. A battery and equipment vest as recited in claim 10 wherein said left shoulder and said right shoulder include one of said rings secured thereto.

27. A battery and equipment vest as recited in claim 26 wherein said rings on said left shoulder and said right shoulder are structured and disposed to support a backpack for carrying a light stand or other accessories attached thereto, or for hanging said battery and equipment vest when not in use.

* * * * *